United States Patent [19]

Brockmanns et al.

[11] Patent Number: 4,573,312

[45] Date of Patent: Mar. 4, 1986

[54] FRICTION SPINNING APPARATUS

[75] Inventors: Karl-Josef Brockmanns, Anrath; Joachim Lünenschloss, Aachen, both of Fed. Rep. of Germany

[73] Assignee: W. Schlafhorst & Co., Monchen-Gladbach, Fed. Rep. of Germany

[21] Appl. No.: 644,220

[22] Filed: Aug. 23, 1984

[51] Int. Cl.[4] ..... D01H 7/882; D02G 3/36

[52] U.S. Cl. ..... 57/5; 57/401; 57/409; 57/411

[58] Field of Search ..... 57/400, 401, 408, 409, 57/411, 327, 5, 224

[56] References Cited

U.S. PATENT DOCUMENTS

| | | | |
|---|---|---|---|
| 4,130,983 | 12/1978 | Dammann et al. | 57/5 |
| 4,168,601 | 9/1979 | Didek et al. | 57/401 |
| 4,202,163 | 5/1980 | Turk et al. | 57/327 X |
| 4,241,574 | 12/1980 | Turk et al. | 57/401 X |
| 4,281,507 | 8/1981 | Didek et al. | 57/401 |

*Primary Examiner*—John Petrakes

*Attorney, Agent, or Firm*—Herbert L. Lerner; Laurence A. Greenberg

[57] ABSTRACT

A friction spinning apparatus, includes oppositely-disposed, rotationally-symmetrical friction elements rotating in the same direction, the friction elements having perforated casings defining a line of closest mutual approach between the casings and two wedge-shaped regions adjacent the line of closest mutual approach, stationery suction devices disposed in the casings, the suction devices having suction apertures directed toward the perforated casings, a fiber feeding device for feeding spinning fibers along a yarn withdrawing direction, and a yarn withdrawing device for withdrawing yarn, each of the casings including a yarn formation zone receiving the spinning fibers at substantially the furthest upstream portion of the casings in the yarn withdrawing direction for continuously forming yarn, a curved transition zone downstream of the yarn formation zone, and a yarn consolidation zone downstream of the transition zone, the yarn consolidation zone being separate from and having a longitudinal axis disposed outside of the yarn formation zone, the yarn consolidation zone being disposed substantially at the furthest downstream portion of the casings.

19 Claims, 7 Drawing Figures

FRICTION SPINNING APPARATUS

The invention relates to a friction spinning apparatus, including oppositely-disposed rotation-symmetrical friction elements with perforated casings, which rotate in the same direction and define triangular or wedge-shaped spaces on both sides adjacent a line of closest mutual approach, stationary suction devices disposed in the casings with suction apertures directed at the perforated casings, a fiber feeding device for feeding spinning fibers into a yarn formation zone, and a yarn withdrawing device for withdrawing the yarn which is continuously being formed in the yarn formation zone.

In conventional friction spinning apparatus, the possibility of exerting influence is confined to the yarn structure and to the overall spinning result.

It is accordingly an object of the invention to provide a friction spinning apparatus which overcomes the hereinafore-mentioned disadvantages of the heretofore-known devices of this general type, to improve the spinning result and to create conditions for better influencing the yarn structure.

With the foregoing and other objects in view there is provided, in accordance with the invention, a friction spinning apparatus, comprising oppositely-disposed, rotationally-symmetrical friction elements rotating in the same direction, the friction elements having perforated casings defining a line of closest mutual approach between the casings and two wedge-shaped regions adjacent the line closest mutual approach, stationary suction devices disposed in the casings, the suction devices having suction apertures directed toward the perforated casings, a fiber feeding device for feeding spinning fibers along a yarn withdrawing direction, and a yarn withdrawing device for withdrawing yarn, each of the casings including a yarn formation zone receiving the spinning fibers at substantially the furthest upstream portion of the casings in the yarn withdrawing direction for continuously forming yarn, a curved transition zone downstream of the yarn formation zone, and a yarn consolidation zone downstream of the transition zone, the yarn consolidation zone being separate from and having a longitudinal axis disposed outside of the yarn formation zone, the yarn consolidation zone being disposed substantially at the furthest downstream portion of the casings.

Feeding of the fibers takes place, as a general rule, in the yarn formation zone. However, this does not exclude feeding part of the fibers into the transition zone and/or into the yarn consolidation zone, in order to form the structure of the outside layers of the yarn there. In principle, however, the formation of the yarn, and particularly the beginning of the formation of the yarn end, should be separate from the actual consolidation of the yarn, so that influence can be exerted separately on the areas of yarn formation and on the areas of yarn consolidation, and furthermore on the transition area as well.

In accordance with another feature of the invention, the yarn consolidation zone is disposed adjecent one of the wedge-shaped regions.

In accordance with a further feature of the invention, the suction apertures are directed against the yarn formation and yarn consolidation zones. The result of this is that the yarn in process for formation in the yarn formation zone is held pneumatically and kept in contact with the friction element. The same occurrence takes place in the subsequent yarn consolidation zone, to the yarn which has yet to be consolidated and improved. The suction apertures can be in the form of elongated slits, a row of individual slits, or a row of individual holes. A proven and simple form of the suction apertures is the elongated slit.

In accordance with an added feature of the invention, the suction devices include a first suction device having at least one suction aperture directed against the yarn formation zone, and a second suction device having at least one suction aperture directed against the yarn consolidation zone. This is done for the purpose of separately influencing the different zones of yarn formation and of yarn consolidation. This arrangement provides for two suction devices which are separate from each other so that the vacuum can be set and adjusted differently.

In accordance with an additional feature of the invention, the friction elements are a pair of friction elements having two sides, and each of the casings include a yarn formation zone, a transition zone and a yarn consolidation zone on each of the sides forming two threads. In this way the efficiency of the friction spinning machine can be improved considerably and the yarn production can be doubled without any appreciable additional expenditure. One of these yarns is then formed on one side and the other yarn on the other side of a pair of friction elements. In this system, a fiber feeding device is provided for each of these yarns. As a general rule, separate withdrawing devices will also have to be provided for each of the yarns thus produced; however these yarns can also be withdrawn together and can, for example, be twisted together at the same time.

In accordance with still another feature of the invention, the friction elements are a pair of friction elements having two sides, each of the casings include a yarn formation zone and a transition zone, and the casings include a common yarn consolidation zone adjacent the transition zones forming one yarn from two yarn ends separately formed in advance. The aim of this is the formation of one yarn, the component yarn ends of which can be influenced separately before they are combined, while it is also possible to influence the final yarn itself and the way in which it is formed. For example, the yarn can be composed of different fiber components having different colors. According to the length of the yarn formation zone in relation to the length of the transition zone and of the yarn consolidation zone, the yarn which is formed is more in the nature of a single yarn or more in the nature of a plied yarn.

The invention offers the advantage of permitting the formation of the yarn to begin at a point where the adjacent friction element does not yet participate in its formation or in the twisting-in of the fibers.

Thus, the feeding of the fibers can be carried out away from narrow places in the system, and therefore there is more room for accommodating yarn feeding devices.

The yarn produced in the new apparatus need not necessarily be formed exclusively from fibers fed to it in opened condition. It is also possible to use a core yarn around which the fibers are wrapped.

In accordance with still a further feature of the invention, there is provided at least one core yarn feeding device feeding at least one yarn to the casings. The core yarn can be a spun yarn or a yarn formed of one or more filaments. The term "core yarn" should not be interpreted too narrowly; what is meant is a yarn to which fibers that are additionally fed into the system, can be added in one way or the other.

Unlike the spinning fibers, the core yarn which is added need not necessarily pass through the yarn formation zone and the transition zone. It is possible to feed it directly into the yarn consolidation zone.

The idea underlying the invention makes it possible to construct the friction elements in such a way that ample space is available for fiber feeding devices and optionally core yarn feeding devices.

In accordance with still an additional feature of the invention, the friction elements are bottle-shaped and include a bottle neck at which the yarn formation zone is disposed, a bottle belly at which the yarn consolidation zone is disposed, and a transition region between the bottle neck and belly at which the transition zone is disposed. Since the circumferential speed of the bottle neck is different from that of the bottle belly, the twisting-in of the fibers starts slowly, whereas the actual twisting of the yarn is carried out at a somewhat greater speed in the yarn consolidation zone.

In accordance with yet another feature of the invention, the friction elements include a first pair of friction elements at which the yarn formation zone is disposed, and a separate second pair of friction elements at which the yarn consolidation zone is disposed.

In accordance with yet an added feature of the invention, a respective part of the transition zone is disposed at each of the pairs of friction elements. Each of these pairs of friction elements can operate at different circumferential speeds.

In accordance with a further feature of the invention, there is provided another friction element disposed between the friction elements of one of said pairs, forming an aggregate of three friction elements in the form of a left, a middle, and a right friction element having two yarn formation zones. The yarn formation zones are then assigned to this aggregate of three friction elements.

In accordance with another feature of the invention, one of the two yarn formation zones is disposed between said left and middle elements and the other is disposed between the middle and right elements. While this arrangement would seem to be complicated, it actually constitutes a simplification, and moreover, since all three friction elements revolve in the same direction, they can conceivably be operated from a common drive. This aggregate of three frictional elements can preferably be combined with a subsequent pair of friction elements situated closest to the exit point of the material in its flow through the system, and which contain the yarn consolidation zone, or consolidation zones if two yarns are required to be produced.

In accordance with a further feature of the invention, the pair of friction elements between which the other friction element is disposed is the first pair of friction elements, and the second pair of friction elements at which the yarn consolidation zone is disposed is downstream of the first pair.

Preferably, the friction elements of the friction spinning apparatus should have their respective axes longitudinally aligned, if such is feasible.

In accordance with still another feature of the invention, the second pair of friction elements include another left friction element coaxial with the first-mentioned left friction element, and another right friction element coaxial with the first-mentioned right friction element.

In accordance with still an additional feature of the invention, the other left and right friction elements of said second pair have larger outside diameters than the first-mentioned left and right friction elements of the first pair. For one thing, such an arrangement allows the three friction elements of the aggregate of three friction elements to be co-planar; for another, it is of advantage in any event for those friction elements which contain the yarn consolidation zone, to rotate at a higher circumferential speed than the elements which contain the yarn formation zones.

Continuing from the concept of constructing the individual friction element in the shape of a bottle, the bottle-shape is of advantage even when two friction elements, which can be operated from separate drives at different circumferential speeds, are disposed one behind the other in the axial direction. The overall contour of the two elements together can also have the advantageous shape of a bottle.

In accordance with a concomitant feature of the invention, the coaxial friction elements are cylindrical over most of the length thereof, the left and right friction elements of the first and second pairs are curved at adjacent transitional portions thereof, and each two coaxial friction elements have a bottle shape, the transition zone being disposed in a neck region of the bottle shape with respective portions of the transition region being disposed at the first and second pair of friction elements.

Other features which are considered as characteristic for the invention are set forth in the appended claims.

Although the invention is illustrated and described herein as embodied in a friction spinning apparatus, it is nevertheless not intended to be limited to the details shown, since various modifications and structural changes may be made therein without departing from the spirit of the invention and within the scope and range of equivalents of the claims. The construction and method of operation of the invention, however, together with additional objects and advantages thereof will be best understood from the following description of specific embodiments when read in connection with the accompanying drawings, in which:

Figure 1:
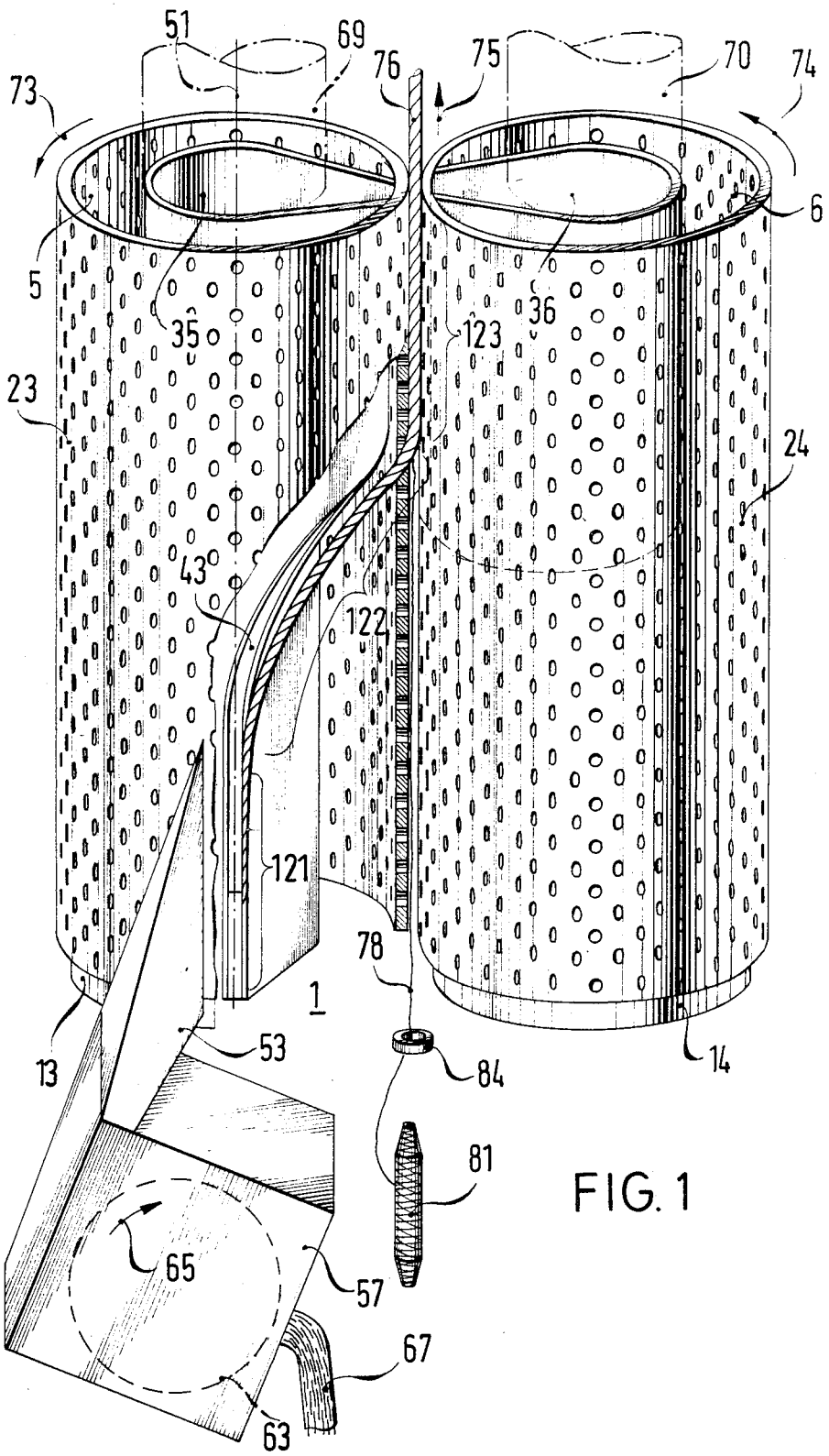
FIG. 1 is a fragmentary, diagrammatic, perspective view of a first embodiment of the invention.
Figure 2:
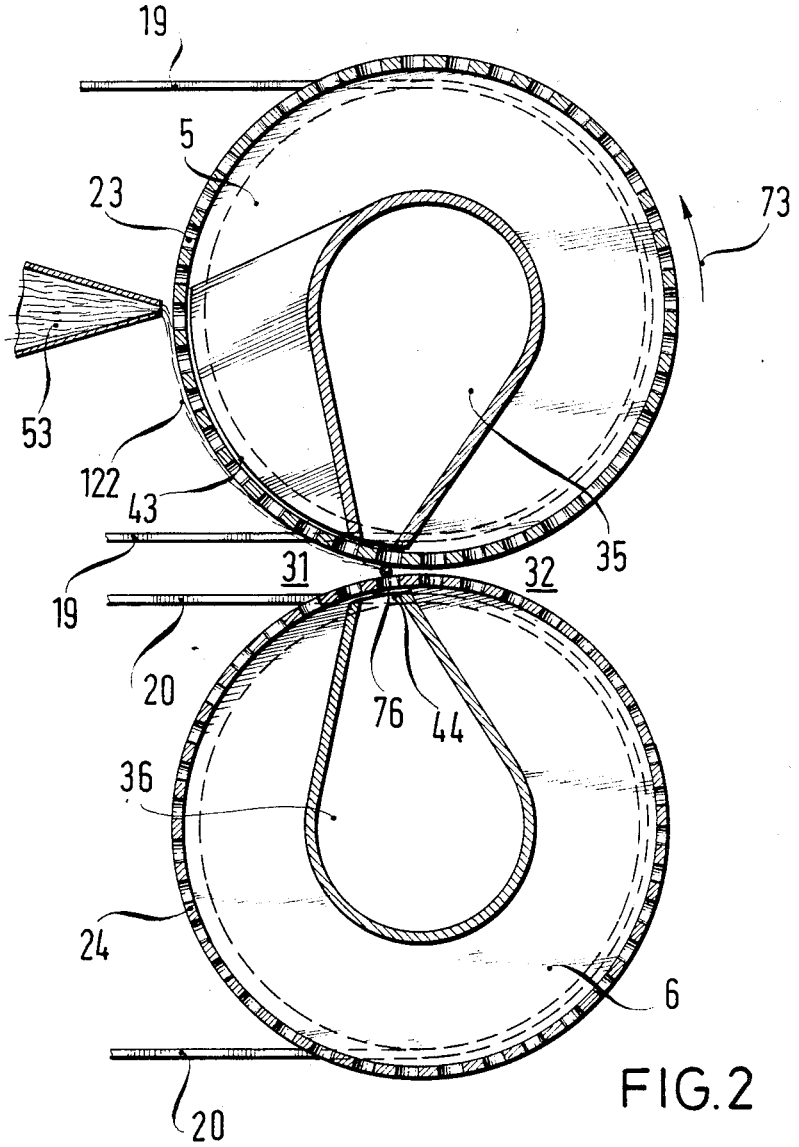
FIG. 2 is a cross-sectional view of the friction element of the first embodiment of the invention.

Referring now to the figures of the drawings in detail and first particularly to FIG. 1 thereof, there is seen a friction spinning apparatus 1 with oppositely disposed rotation-symmetrical friction elements 5, 6 which rotate in the same direction. The friction elements are mounted in such a way that they are rotatable, the method of mounting not being illustrated here, and are provided with belt pulleys 13, 14 for the purpose of providing a rotational drive. As is shown in FIG. 2, a driving belt 19 goes around the belt pulley 13 and a driving belt 20 goes around the belt pulley 14. The friction element 5 has a surface 23 which is perforated all around and the friction element 6 has a surface 24 which is perforated all around.

The friction elements 5, 6 are symmetrical with respect to rotation. In the examples presented here, the friction elements are cylindrical or roller-shaped. The friction elements could, however, also be of conical or hyperbolical shape, although the cylidrical form offers decisive advantages with respect to manufacture.

The friction elements 5, 6 have parallel axes and consequently define between them a straight line of closest mutual approach. As shown in FIG. 2, two triangular or wedge spaces 31, 32, one on each side of the line of closest mutual approach, are limited by the surfaces of the friction elements.

The friction elements include stationary suction devices which are provided with suction apertures directed at the perforated surfaces. The friction element 5 includes the suction device 35 with the slit-shaped suction aperture 43, the friction element 6 includes the suction device 36 with the slit-shaped suction aperture 44. The suction aperture 44 runs in a straight line, the suction aperture 43 follows the line of a helix which, in the direction of the material flow comes into proximity of the line of closest mutual approach of the friction elements 5, 6. FIG. 1 shows the helical course of the suction aperture 43. Considered in the direction of material flow, the suction aperture 43 starts its course parallel to the axis of rotation 51 of the friction element 5, then follows a helix and finally runs again parallel to the axis of rotation 51. The yarn formation zone 121 lies on the surface 23 over the straight initial part of the suction aperture 43. Then follows the transition zone 122 over the helical part. Adjoining the transition zone is the yarn consolidation zone 123 which is situated in the triangular space 31.

In front of the yarn formation zone 121 is the mouth of a fiber feeding device in the form of a fiber feed duct 53 issuing fiber from a fiber loosening device 57.

A needle-covered loosening roller 63 revolves in the fiber loosening device 57 in the direction shown by the arrow 65. It opens a strand or sliver 67 fed to it, into individual fibers which are conveyed through the fiber feed duct 53 to the yarn formation zone 121.

The suction device 35 and its slit-shaped suction aperture 43 are so shaped and arranged that the yarn from the beginning of the process of yarn formation is pneumatically held against and in contact with the surface 23 of the friction element 5 whereby the yarn is rotated. The suction device 36, on the other hand, is only of limited length.

For the sake of clarity of the illustration, the suction devices 35 and 36 are shown in section in the drawing. They are supplied with suction air through a pipe system connected to them. The suction device 35 is connected to the pipe 69, the suction device 36 to the pipe 70.

The two friction elements 5 and 6 revolve in the same direction. The friction element 5 revolves in the direction shown by the arrow 73, the friction element 6 in the direction shown by the arrow 74. The yarn 76 is withdrawn in the direction shown by the arrow 75 by means of a yarn withdrawing device not illustrated here.

It can be seen from FIG. 1 that a core yarn 78 is added to the yarn 76, the core yarn being supplied from a core yarn feeding device 81 through a yarn guide 84.

During the spinning process, the yarn 76 being formed is rotated on the surface 23 with its end tapering to a thin point. Due to the frictional forces it is held in the yarn formation zone 121, in the transition zone 122 and in the yarn consolidation zone 123. The frictional forces result from the suction effect, and to these are added, in the places where the yarn has already come into contact with the neighboring friction element 6, to the mechanical forces of the friction elements 5 and 6 rotating in the same direction.

Figure 3:
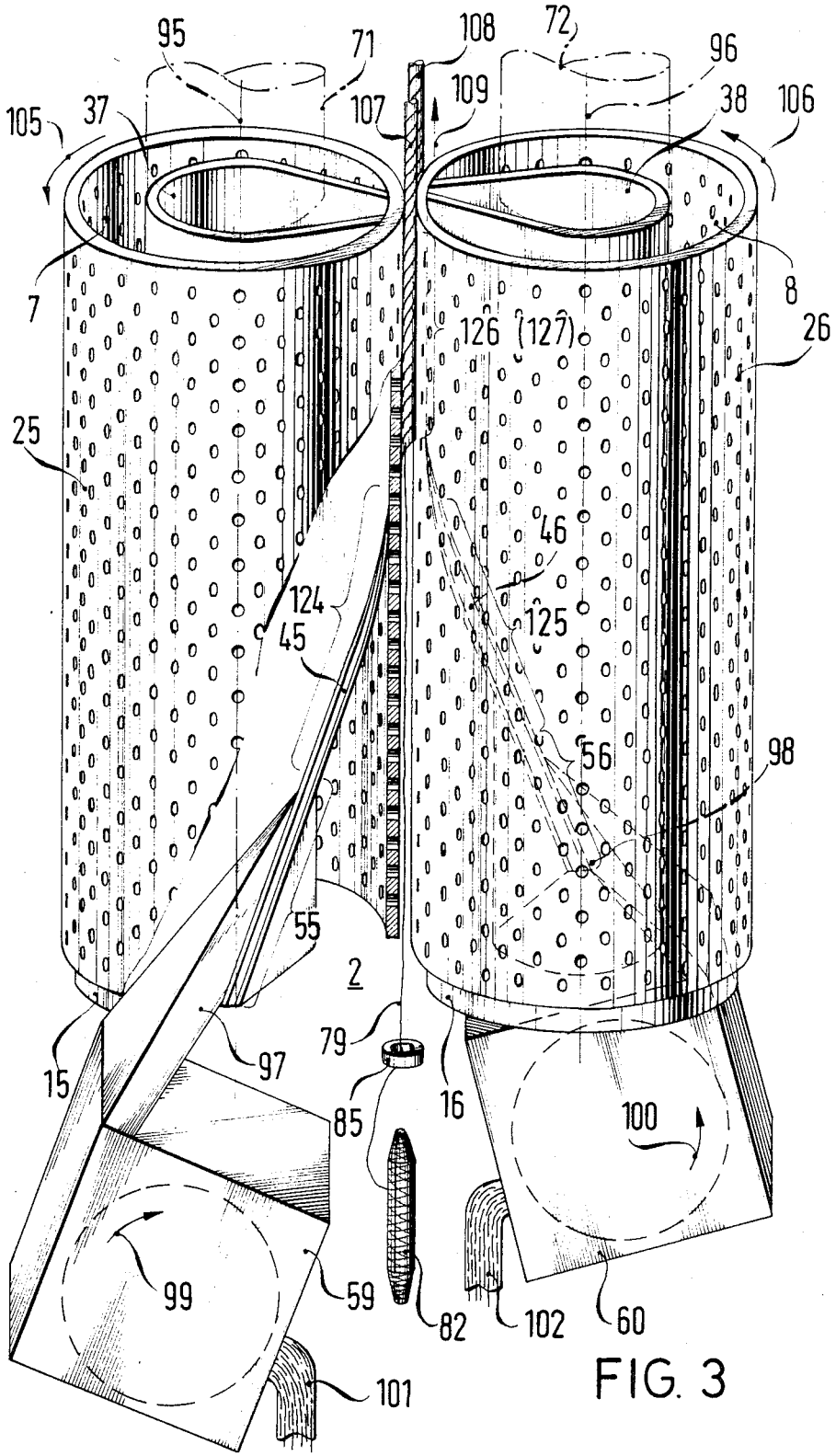
FIG. 3 is a view similar to FIG. 1 of a second embodiment of the invention.

In the example of the second embodiment of the invention, which is similar to the example of the first embodiment, FIG. 3 shows a frictional spinning apparatus 2 with rotation-symmetrical friction elements 7, 8. The friction elements are mounted in such a way that they are rotatable, the method for mounting not being illustrated in detail here, and are provided, for the purpose of rotational drive, with belt pulleys 15, 16. The friction element 7 has a surface 25 which is perforated all round, the friction element 8 has a surface 26 which is perforated all round.

The friction elements in these examples are cylindrical or roller-shaped. They are arranged with their axes parallel and consequently define between them a straight line of closest mutual approach. There are two triangular spaces, one on each side of the line of closest mutual approach, similar to those shown in FIG. 2, and limited by the surfaces of the friction elements.

The friction element 7 includes a suction device 37 with the slit-shaped suction aperture 45, the friction element 6 a suction device 38 with the slit-shaped suction aperture 46. The suction apertures 45, 46 are staggered, the individual suction aperture being directed at that triangular space in which the feeding of the fibers takes place. Each system of suction apertures is situated along a helix which, in the direction of the material flow comes into proximity with the line of closest mutual approach of the friction elements 7, 8. The suction aperture 45 follows a helix from the start and, in its position closest to the exit point of the material, runs parallel to the axis of rotation 95 of the friction element 7. Likewise, the suction aperture 46 follows a helix from the start and ends in a course parallel to the axis of rotation 96 of the friction element 8.

Each of the two triangular spaces is provided with a fiber feeding device in the form of a fiber feed duct issuing fibers from a fiber opening device. The fiber feed duct 97 assigned to the triangular space situated in front has its mouth at a distance from the surface 25 over the yarn formation zone 55 which lies on the surface 25 over the suction aperture 45.

Similarly, the fiber feed duct 98 assigned to the triangular space situated at the back has its mouth at a distance from the surface 26 over the yarn formation zone 46, which lies on the surface 26 over the suction aperture 46.

The fiber feeding device, or fiber feed duct 97, issuing fibers from a fiber opening device 59. In the fiber loosening device 59 a needle-covered loosening roller revolves in the direction shown by the arrow 99. This loosening roller opens a sliver of fibers 101 fed to it, into individual fibers which are then conveyed through the fiber feed duct 97 to the yarn formation zone 55.

The other fiber feed duct 98 issues fibers from a fiber loosening device 60, in which a loosening roller revolves in the direction shown by the arrow 100. It opens a sliver of material 102 fed to it into individual fibers, which are then conveyed through the fiber feed duct 98 to the yarn formation zone 56.

In the triangular space situated in the front, the yarn formation zone 55 is followed by an adjoining transition zone 124, which in turn is followed by an adjoining yarn consolidation zone 126. In the triangular or wedge space situated at the rear, the yarn formation zone 56 is followed by an adjoining transition zone 125 which in turn is followed by an adjoining yarn consolidation zone 127.

For the sake of clarity of the illustration, the suction devices 37 and 38 are shown in section. They are supplied with suction air through pipes connected to them. The suction device 37 is connected to the pipe 71 and the suction device 38 is connected to the pipe 72.

The two friction elements 7 and 8 rotate in the same direction. The friction element 7 rotates in the direction shown by the arrow 105, the friction element 8 rotates in the direction shown by the arrow 106.

The two yarns 107 and 108 are withdrawn in the direction shown by the arrow 109 by means of a yarn withdrawing device not illustrated here.

It can be seen from FIG. 3, that a core yarn 79 is added to the yarn 107, the core yarn being supplied from a core yarn feeding device 82 through a yarn guide 85.

During spinning, the yarns 107 and 108 in process of being formed are rotated on the respective surfaces 25 or 26 with their ends tapering to thin points. Due to the frictional forces they are held in the zones which are situated over the suction apertures 45, 46. The friction forces result from the suction effect, to which are added, in the places where a yarn has already come into contact with the neighboring friction element, the mechanical forces of the friction elements 7 and 8 rotating in the same direction.

Figure 6:
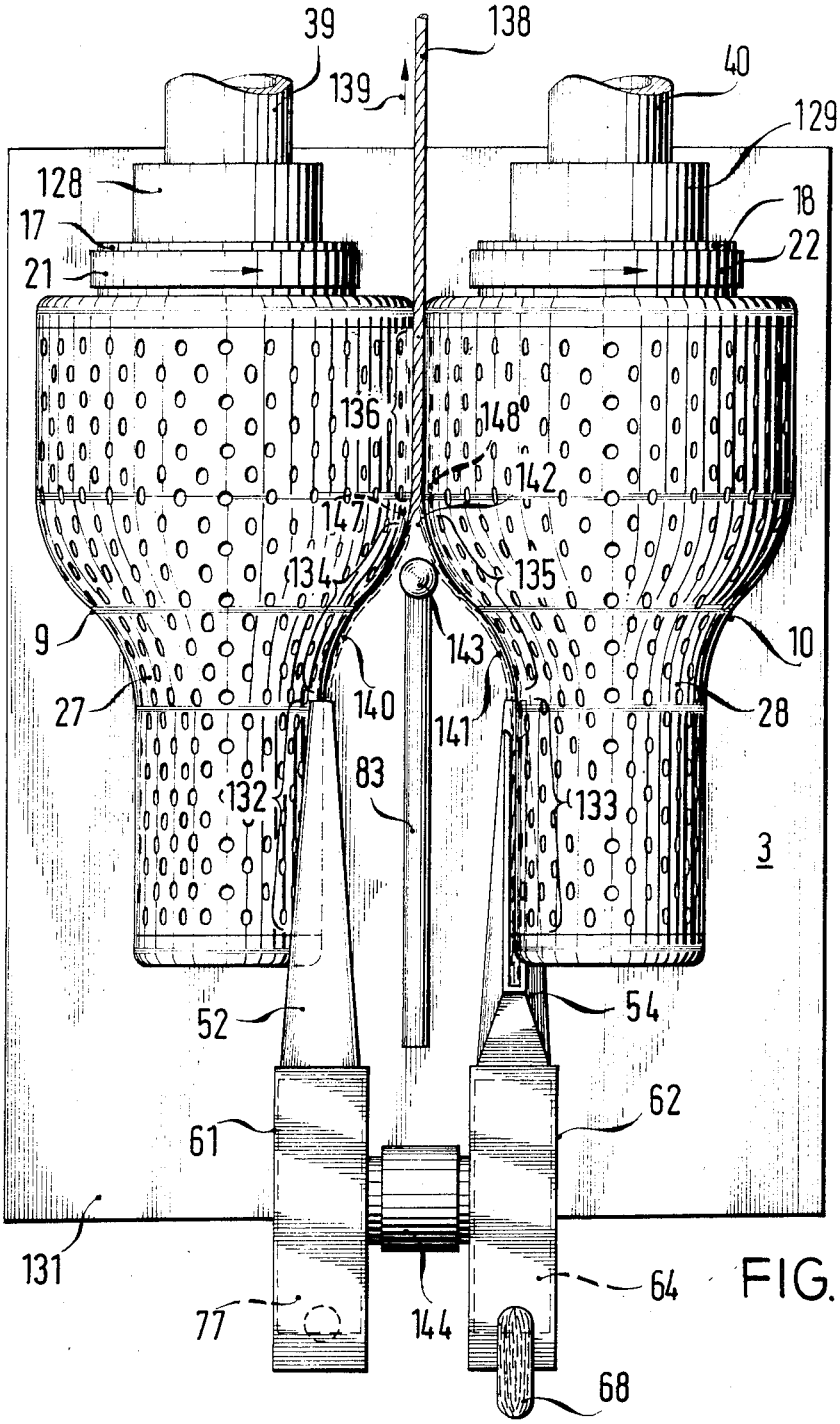
FIG. 6 is a top plan view of a fourth embodiment of the invention.
Figure 7:
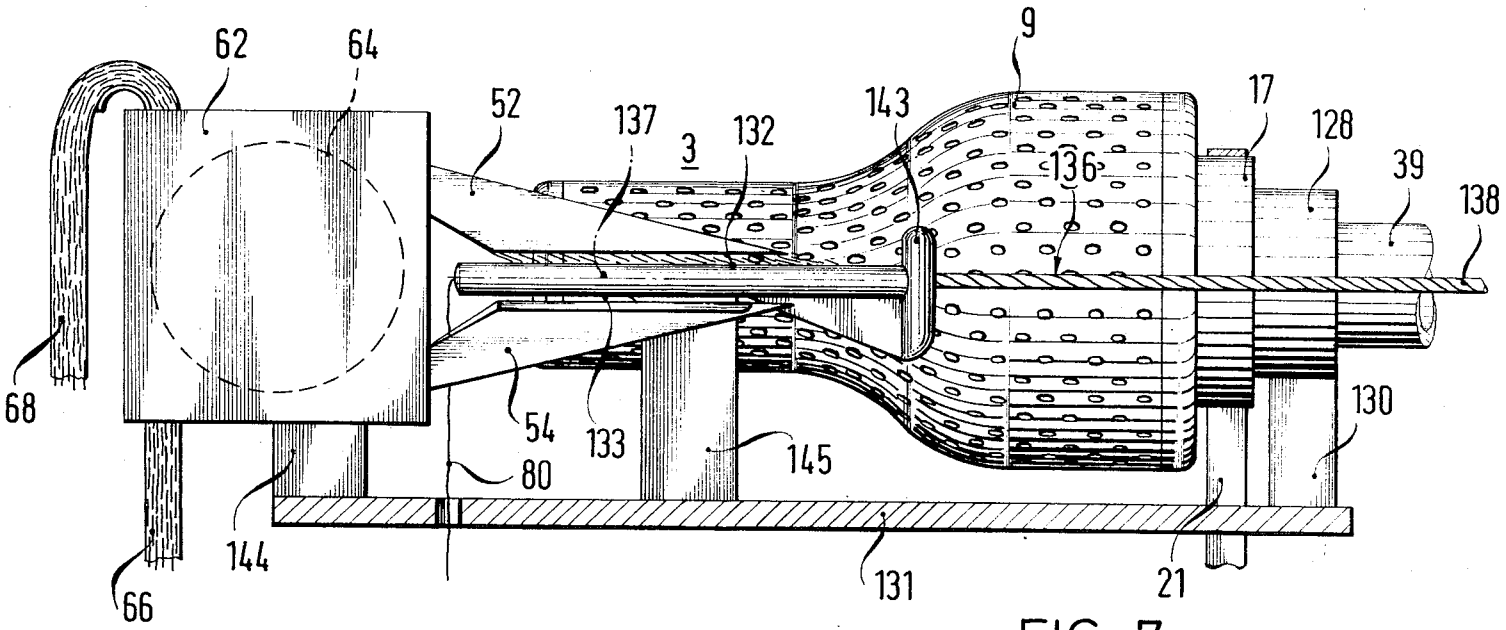
FIG. 7 is a side-elevational view of the fourth embodiment of the invention.

The example of an embodiment according to FIGS. 6 and 7 shows a friction spinning apparatus 3 comprising juxtaposed, rotation-symmetrical friction elements 9, 10 which rotate in the same direction. The friction element 9 is mounted on a suction device 39, about which it rotates, by means of a roller bearing 128 and a support 130 connected to a base plate 131. Likewise, the friction element 10 is mounted on a suction device 40 by means of a roller bearing 129. The friction elements 9, 10 are provided, for the purpose of rotational drive, with belt pulleys 17, 18. A belt 21 goes around the belt pulley 17 and a belt 22 goes around the belt pulley 18. The friction element 9 has a casing 27 which is perforated all round, the friction element 10 has a casing 28, which is perforated all round.

The two friction elements 9, 10 are bottle-shaped, the yarn formation zone 132 of the friction element 9 being situated at the neck of the bottle and the yarn consolidation zone 136, which the two friction elements have in common, being situated at the belly of the bottle. The transition zone 134 of the friction element 9 lies in the region of the change-over as the bottleneck passes to the bottle belly, and this applies likewise to the transition zone 135 of the friction element 10 which also has its yarn formation zone 133 at the bottleneck.

Similarly as shown in the preceding examples of embodiments, the suction devices 39 and 40 project into the interior of the friction elements.

Their suction apertures 147 and 148, in FIG. 6 sketched out in a broken line, follow the bottle-shape of the surfaces and are directed at the zones. The two suction devices 39 and 40 are connected to a common source of vacuum. It can be seen from the drawings that on each side of the pair of friction elements 9, 10 are situated a yarn formation zone 132 or 133, and a transition zone 134 or 135, and that the two transition zones pass into one common yarn consolidation zone 136. FIG. 7 shows that the yarn formation zone 132 lies above, and the yarn formation zone 133 below, the central plane 137. The yarn 138 is continuously being withdrawn in the direction shown by the arrow 139 by yarn withdrawing means not illustrated here. It is formed from the two yarn ends 140 and 141. A yarn separator 143 is provided before the junction point 142 of the two yarn ends, and is designed to prevent the yarn ends from being lifted away from the transition zones 134 and 135.

The friction elements 9, 10 are arranged with their axes parallel and consequently define between themselves a straight line of closest mutual approach. On each side of the line of closest mutual approach there are at the belly parts of the friction elements, wedge spaces, an upper one and a lower one, confined by the surfaces of the friction elements.

In front of the yarn formation zone 132 is the mouth of a fiber feeding device in the form of a fiber feed duct 52 which issues fibers from a loosening device 61. In front of the other yarn formation zone 133 is the mouth of a further fiber feeding device in the form of a fiber feed duct 54 coming from below and issuing fibers from a fiber loosening device 62.

The two fiber loosening devices 61 and 62 are connected to the base plate 131 by a supporting structure 144. Needle-covered opening rollers revolve in the fiber loosening devices 61, 62, loosening the slivers or strands 66 and 68, which are fed to them, into individual fibers, which are conveyed through the fiber feed ducts to the yarn formation zones. In FIG. 7, the opening roller 64 is shown in a broken line. FIG. 6 also shows the loosening roller 64 and, in addition, the loosening roller 77, belonging to the fiber loosening device 61, in a broken line.

It can be seen particularly in FIG. 7 that a core yarn 80 is added to the yarn 138. For this purpose, a tubular core-yarn feeding device 83 is provided. The core-yarn 80 coming from below is fed into the end of the tubular core-yarn feeding device 83 and comes out of it through an aperture in the yarn separator 143. A supporting structure 145 connects the core-yarn feeding device 83, and the yarn separator 143 attached to it, to the base plate 131.

Figure 4:
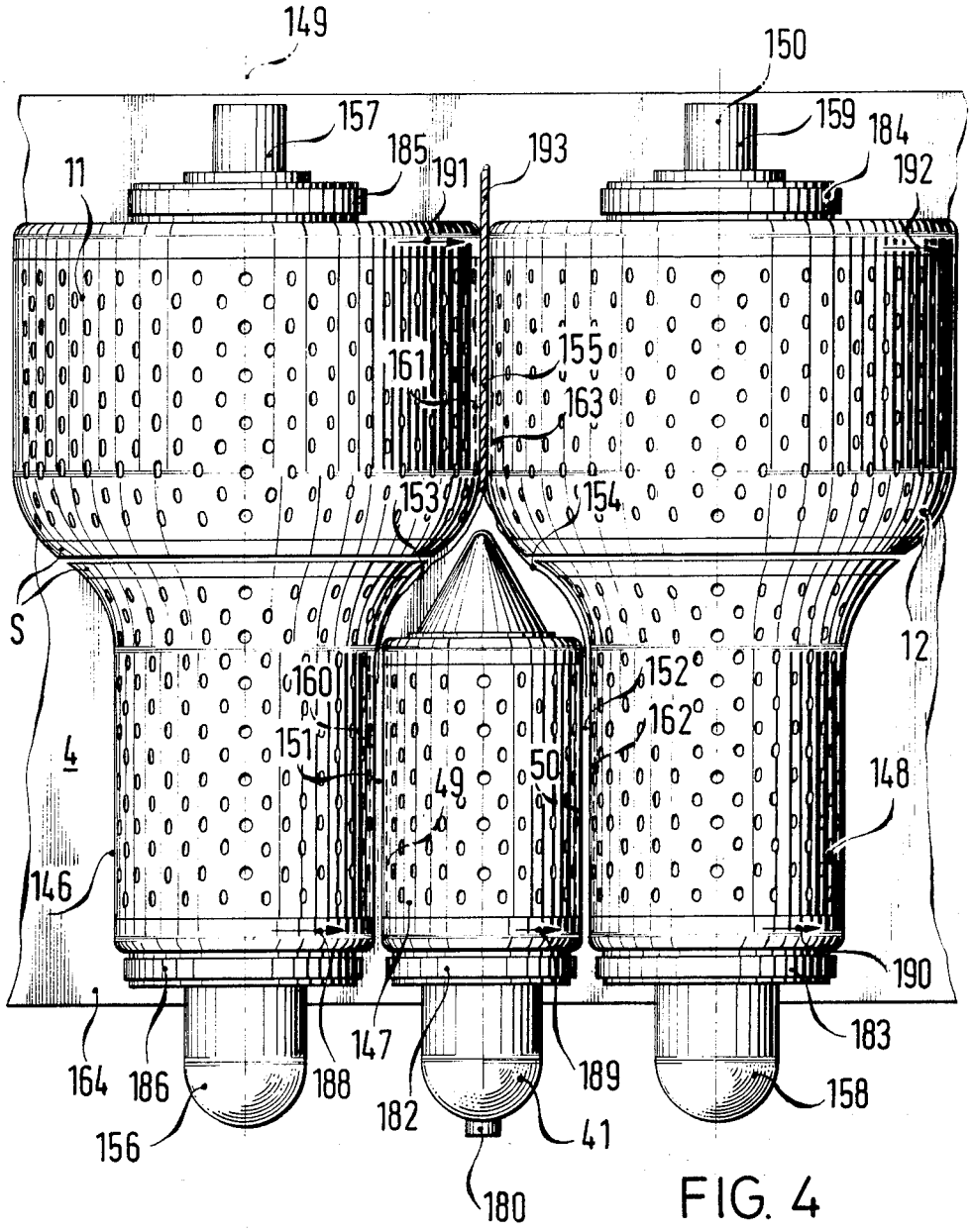
FIG. 4 is a fragmentary top plan view of a third embodiment of the invention.
Figure 5:
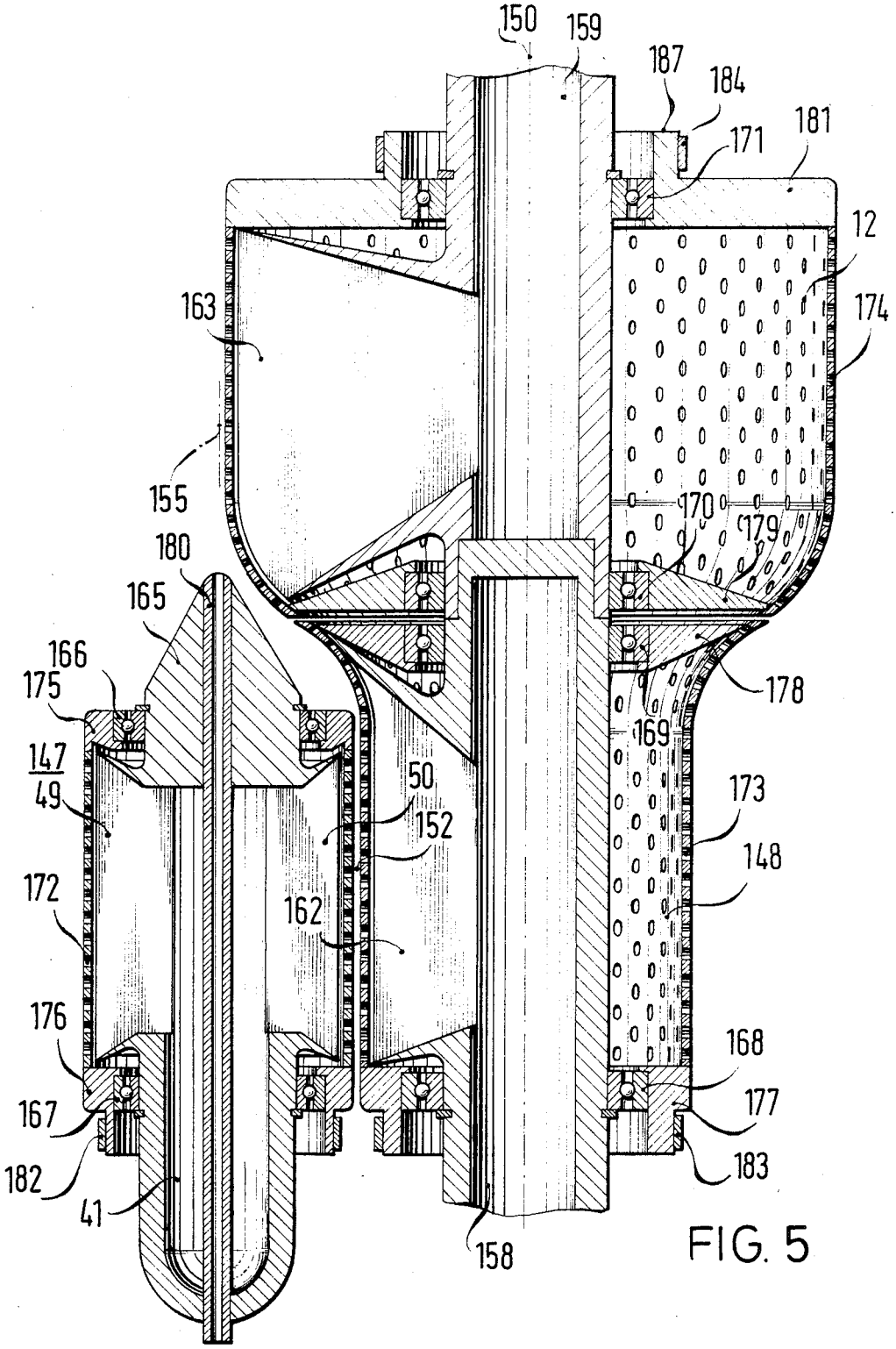
FIG. 5 is a fragmentary cross-sectional view showing details of the third embodiment of the invention.

In the example of an embodiment according to FIGS. 4 and 5, the friction spinning apparatus 4 comprises a pair of friction elements consisting of the friction elements 11, 12, and also an aggregate of three friction elements consisting of a left-hand friction element 146, a middle friction element 147 and a right-hand friction element 148. The pair of friction elements 11, 12 is arranged behind the aggregate of three friction elements 146, 147, 148. The left-hand friction element 146 of the aggregate of three friction elements is rotatable about the same axis as the left-hand friction element 11 of the pair of friction elements.

The right-hand friction element 148 of the aggregate of three friction elements is rotatable about the same axis as the right-hand friction element 12 of the pair of friction elements. The two friction elements 11, 12 of the pair of friction elements have a larger outside diameter than the two outer friction elements 146, 148 of the aggregate of three friction elements. The friction elements 11, 146 and 12, 148 respectively, which are rotatable about the same axis, are cylindrical for most of their length, while the parts of the two friction elements which adjoin one another follow an S-shaped transitional curve S and are shaped in such a way that the whole takes the form of a bottle.

A first yarn formation zone 151 lies between the friction elements 146 and 147, and a second yarn formation zone 152 lies between the friction elements 147 and 148. Between the two friction elements 11 and 12 of the pair of friction elements lies a common yarn consolidation zone 155. The two transition zones 153, 154 are each situated in the S-shaped neck regions, partly on the friction element 146 and partly on the friction element 11, or partly on the friction element 148 and partly on the friction element 12, respectively.

The suction devices are arranged in pairs on the left-hand and on the right-hand side, as shown in FIG. 4. On the left-hand side, the suction aperture 160 of a first suction device 156 is directed at the yarn formation zone 151. On the same side, the suction aperture 161 of a second suction device 157 is directed at the yarn consolidation zone 155. On the right-hand side, the suction aperture 162 of a first suction device 158 is directed at the yarn formation zone 152, and the suction aperture 163 of a second suction device 159 is directed at the common yarn consolidation zone 155.

The friction element 147 possesses a suction device 41 of its own, which has its suction apertures 49 and 50 directed at the yarn forming zones 151 and 152 respectively. The ends of all the suction devices, which are tubular and bent downwards, are connected to a base plate 164. Moreover, they carry the friction elements in a manner which is shown in principle in FIG. 5.

As shown in FIG. 5, the stationary suction device 41 ends in a conical taper 165, which carries a roller bearing 166. A second roller bearing 167 is provided on the tubular horizontal part of the suction device 41. The roller bearing 166 carries a disc 175, and the roller bearing 167 carries a disc 176. The two discs 175, 176 support the perforated casing 172 of the friction element 147. A tubular core-yarn feeding device 180, which has its outlet at the conical taper 165, is provided in a horizontal longitudinal bore of the suction device 41.

The horizontal part of the suction device 158 carries two roller bearings 168 and 169. The roller bearing 168 carries a ring 177, the roller bearing 169 carries a disc 178. The perforated casing 173 of the friction element 148 extends from the ring 177 to the disc 178.

The horizontal part of the suction device 159 carries two roller bearings 170, 171, which in turn carry discs 179 and 181 respectively.

The perforated casing 174 of the friction element 12 extends between the discs 179 and 181.

A driving belt 182 goes round the front part of the ring 176, and a driving belt 183 goes round the front part of the ring 177. The disc 181 has an annular extension 187 round which goes a driving belt 184. Correspondingly, the friction elements 11 and 146 are driven by driving belts 185 and 186 respectively. The friction elements 11 and 146 rotating about the rotation axis 149 have the same design as the friction elements 12 and 148, illustrated in FIG. 5, which rotate about the rotation axis 150. Accordingly, the suction devices 156 and 157 are symmetrical to the suction devices 158 and 159 respectively.

As shown in FIG. 4, for the production of yarn the are to be fed into the yarn formation zone 151 from above, whereas the fibers are fed into the yarn formation zone 152 from below. All the friction elements rotate here in the same direction, namely in the direction shown by the arrows 188 to 192. The component yarn ends produced in the yarn formation zones 151 and 152 are combined into a single yarn 193 which is continuously withdrawn by withdrawing means not illustrated here. A core yarn can be added by means of the core-yarn feeding device 180.

It is of advantage during spinning to adjust the circumferential speeds of the friction elements 146, 147 and 148 to the same values. While the circumferential speeds of the friction elements 11 and 12 of the pair of friction elements are mutually equal, these need not necessarily agree with the circumferential speeds of the friction elements of the aggregate of three friction elements; they can, for example, be greater. This has an influence on the yarn strength, the appearance of the yarn and the yarn structure. Moreover, there is a possibility of also feeding fibers into the common yarn consolidation zone 155, and these fibers can then form the outer layers of the yarn 193.

The invention is not limited to the examples of embodiments, illustrated and described hereinbefore.

We claim:

1. Friction spinning apparatus, comprising oppositely-disposed, rotationally-symmetrical friction elements rotating in the same direction, said friction elements having perforated casings defining a line of closest mutual approach between said casings and two wedge-shaped regions adjacent said line of closest mutual approach, stationary suction devices disposed in said casings, said suction devices having suction apertures directed toward said perforated casings, a fiber feeding device for feeding spinning fibers along a yarn withdrawing direction, and a yarn withdrawing device for withdrawing yarn, each of said casings including a yarn formation zone receiving the spinning fibers at substantially the furthest upstream portion of said casings in said yarn withdrawing direction for continuously forming yarn, a curved transition zone downstream of said yarn formation zone, and a yarn consolidation zone downstream of said transition zone, said yarn consolidation zone being separate from and having a longitudinal axis disposed outside of said yarn formation zone, said yarn consolidation zone being disposed substantially at the furthest downstream portion of said casings.

2. Friction spinning apparatus according to claim 1, wherein said yarn consolidation zone is disposed adjacent one of said wedge-shaped regions.

3. Friction spinning apparatus according to claim 1, wherein said suction apertures are directed against said yarn formation and yarn consolidation zones.

4. Friction spinning apparatus according to claim 1, wherein said suction devices include a first suction device having at least one suction aperture directed against said yarn formation zone, and a second suction device having at least one suction aperture directed against said yarn consolidation zone.

5. Friction spinning apparatus according to claim 1, wherein said friction elements are a pair of friction elements, said yarn formation zones each have two ends, and each of said casings include a transition zone and a yarn consolidation zone each being disposed at a respective one of said ends forming two threads.

6. Friction spinning apparatus according to claim 1, wherein said friction elements are a pair of friction elements, each of said casings include a yarn formation zone and a transition zone, and said casings include a common yarn consolidation zone adjacent said transition zones forming one yarn from two yarn ends separately formed in advance.

7. Friction spinning apparatus according to claim 1, including at least one core yarn feeding device feeding at least one yarn to said casings.

8. Friction spinning apparatus according to claim 1, wherein said friction elements are bottle-shaped and include a bottle neck at which said yarn formation zone is disposed, a bottle belly at which said yarn consolidation zone is disposed, and a transition region between said bottle neck and belly at which said transition zone is disposed.

9. Friction spinning apparatus according to claim 1, wherein said friction elements include a first pair of friction elements at which said yarn formation zone is disposed, and a separate second pair of friction elements at which said yarn consolidation zone is disposed.

10. Friction spinning apparatus according to claim 9, wherein a respective part of said transition zone is disposed at each of said pairs of friction elements.

11. Friction spinning apparatus according to claim 10, including another friction element disposed between said friction elements of one of said pairs, forming an aggregate of three friction elements in the form of a left, a middle, and a right friction element having two yarn formation zones.

12. Friction spinning apparatus according to claim 11, wherein one of said two yarn formation zones is disposed between said left and middle elements and the other is disposed between said middle and right elements.

13. Friction spinning apparatus according to claim 9, including another friction element disposed between said friction elements of one of said pairs, forming an aggregate of three friction elements in the form of a left, a middle, and a right friction element having two yarn formation zones.

14. Friction spinning apparatus according to claim 13, wherein one of said two yarn formation zones is disposed between said left and middle elements and the other is disposed between said middle and right elements.

15. Friction spinning apparatus according to claim 13, wherein said pair of friction elements between which said other friction element is disposed is said first pair of friction elements, and said second pair of friction elements at which said yarn consolidation zone is disposed is downstream of said first pair.

16. Friction spinning apparatus according to claim 15, wherein said second pair of friction elements include another left friction element coaxial with said first-mentioned left friction element, and another right friction element coaxial with said first-mentioned right friction element.

17. Friction spinning apparatus according to claim 16, wherein said other left and right friction elements of said second pair have larger outside diameters than said first-mentioned left and right friction elements of said first pair.

18. Friction spinning apparatus according to claim 17, wherein said coaxial friction elements are cylindrical over most of the length thereof, said left and right friction elements of said first and second pairs are curved at adjacent transitional portions thereof, and each two coaxial friction elements have a bottle shape, said transition zone being disposed in a neck region of the bottle shape with respective portions of said transition region beind disposed at said first and second pair of friction elements.

19. Friction spinning apparatus according to claim 1, wherein said casings are cylindrical at least at a portion thereof, said yarn formation zone and said yarn consolidation zone being separated from each other by said cylindrical portion in each casing.

* * * * *